US011097412B2

(12) United States Patent
Dosky

(10) Patent No.: US 11,097,412 B2
(45) Date of Patent: Aug. 24, 2021

(54) MECHANIC'S CREEPER ASSEMBLY

(71) Applicant: Rekeft Dosky, Kitchener (CA)

(72) Inventor: Rekeft Dosky, Kitchener (CA)

( * ) Notice: Subject to any disclaimer, the term of this patent is extended or adjusted under 35 U.S.C. 154(b) by 322 days.

(21) Appl. No.: 16/385,324

(22) Filed: Apr. 16, 2019

(65) Prior Publication Data

US 2020/0331140 A1 Oct. 22, 2020

(51) Int. Cl.
*B25H 5/00* (2006.01)
*A45F 3/04* (2006.01)

(52) U.S. Cl.
CPC ..... *B25H 5/00* (2013.01); *A45F 3/04* (2013.01)

(58) Field of Classification Search
CPC ..... B25H 5/00; A45F 3/04
See application file for complete search history.

(56) References Cited

U.S. PATENT DOCUMENTS 1,081,340 A * 12/1913 Spangler ..... A47L 5/34 15/355
1,663,364 A * 3/1928 Adams ..... A47L 5/34 15/354
2,787,009 A * 4/1957 Hagerty ..... B25H 5/00 5/640
3,000,647 A * 9/1961 Fox ..... A01D 34/74 280/43.17
3,038,736 A * 6/1962 Root ..... A01D 34/74 280/43.17
3,147,987 A * 9/1964 Mikelis ..... A01D 34/74 56/255
3,421,776 A * 1/1969 Stockburger ..... A01D 34/74 280/43.17
3,649,828 A * 3/1972 Price ..... A01D 34/74 280/43.17
4,185,846 A 1/1980 Black
4,909,524 A * 3/1990 Paine ..... B25H 5/00 2/46
5,108,118 A * 4/1992 Schaevitz ..... B25H 5/00 280/32.6
5,253,885 A * 10/1993 McCracken ..... B62B 15/00 280/19
5,791,004 A * 8/1998 Hammadi ..... A47L 11/16 15/49.1
D460,614 S 7/2002 Reimers
(Continued)

FOREIGN PATENT DOCUMENTS

CN 109129383 A * 1/2019

*Primary Examiner* — Jacob B Meyer

(57) ABSTRACT

A mechanic's creeper assembly includes a panel that can be worn on a user's back. A first belt is slidably coupled to the panel and the first belt can be wrapped around the user to retain the panel on the user's back. A second belt is slidably coupled to the panel and the second belt can be wrapped around the user to retain the panel on the user's back. A pair of wheel mounts is each of the wheel mounts is coupled to opposite sides of the panel and each of the wheel mounts has a plurality of engagement points thereon. A pair of wheel units is provided and each of the wheel units is removably coupled to a respective one of the wheel mounts for rolling along the ground. Each of the wheel units engages a selected one of the engagement points in the respective wheel mount thereby spacing each of wheel units a selectable distance below the panel.

12 Claims, 6 Drawing Sheets

(56) References Cited

U.S. PATENT DOCUMENTS 6,578,857 B1 * 6/2003 Whiteside ..... B25H 5/00 280/32.5
6,604,747 B2 * 8/2003 Moore ..... A62B 1/02 280/20
7,025,421 B1 * 4/2006 Fowler ..... A47C 1/026 297/325
7,032,907 B1 4/2006 Marsh
7,114,742 B1 10/2006 Sterns
7,374,181 B1 * 5/2008 Wu ..... B25H 5/00 280/32.5
7,434,817 B2 10/2008 Rush
7,478,444 B1 * 1/2009 Darrigo ..... A61G 7/103 280/32.6
7,685,656 B1 * 3/2010 Darrigo ..... A61G 7/103 5/81.1 HS
7,726,668 B2 * 6/2010 Sieb ..... B25H 5/00 280/32.6
8,038,042 B2 10/2011 Bartel
9,126,326 B1 * 9/2015 Bowen ..... B25H 5/00
D742,462 S * 11/2015 Cotto-Colon ..... D21/662
9,242,368 B2 * 1/2016 Huang ..... B25H 5/00
9,242,369 B1 1/2016 Richmond
10,392,131 B2 * 8/2019 Deck ..... B33Y 80/00
2006/0186619 A1 * 8/2006 Sieb ..... B25H 5/00 280/32.6
2007/0176378 A1 * 8/2007 Bangs ..... B25H 5/00 280/32.6
2008/0136129 A1 * 6/2008 Wu ..... B25H 5/00 280/32.6
2011/0049822 A1 * 3/2011 Hinman ..... B25H 5/00 280/32.6
2015/0246441 A1 * 9/2015 Huang ..... B25H 3/06 206/557
2016/0332483 A1 * 11/2016 Sieb ..... B25H 5/00
2020/0331140 A1 * 10/2020 Dosky ..... A45F 3/04

* cited by examiner

MECHANIC'S CREEPER ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to creeper devices and more particularly pertains to a new creeper device for that can be strapped to a user's back for rolling on the ground.

BRIEF SUMMARY OF THE INVENTION

An embodiment of the disclosure meets the needs presented above by generally comprising a panel that can be worn on a user's back. A first belt is slidably coupled to the panel and the first belt can be wrapped around the user to retain the panel on the user's back. A second belt is slidably coupled to the panel and the second belt can be wrapped around the user to retain the panel on the user's back. A pair of wheel mounts is each of the wheel mounts is coupled to opposite sides of the panel and each of the wheel mounts has a plurality of engagement points thereon. A pair of wheel units is provided and each of the wheel units is removably coupled to a respective one of the wheel mounts for rolling along the ground. Each of the wheel units engages a selected one of the engagement points in the respective wheel mount thereby spacing each of wheel units a selectable distance below the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
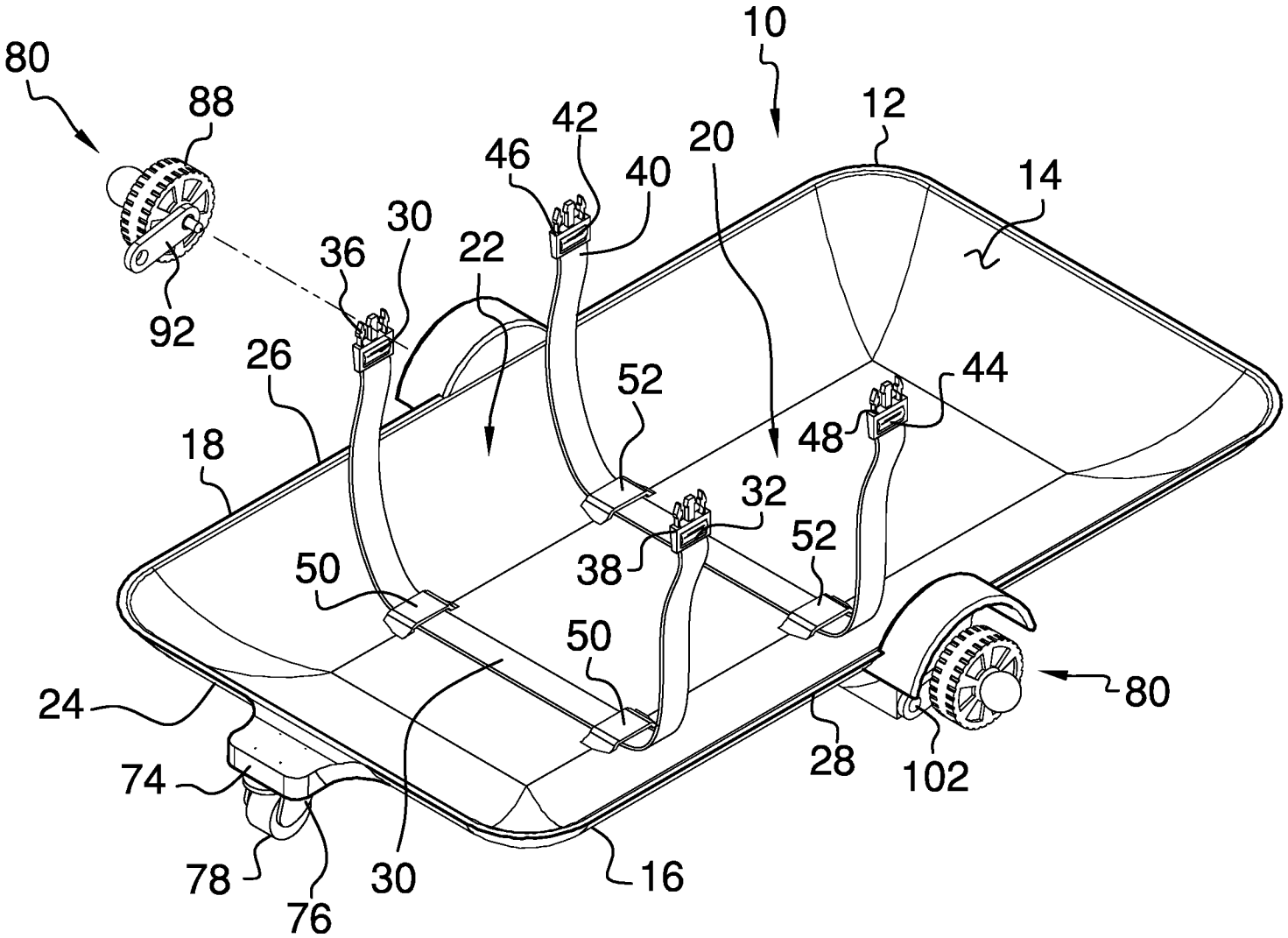
FIG. 1 is a top perspective view of a mechanic's creeper assembly according to an embodiment of the disclosure.
Figure 2:
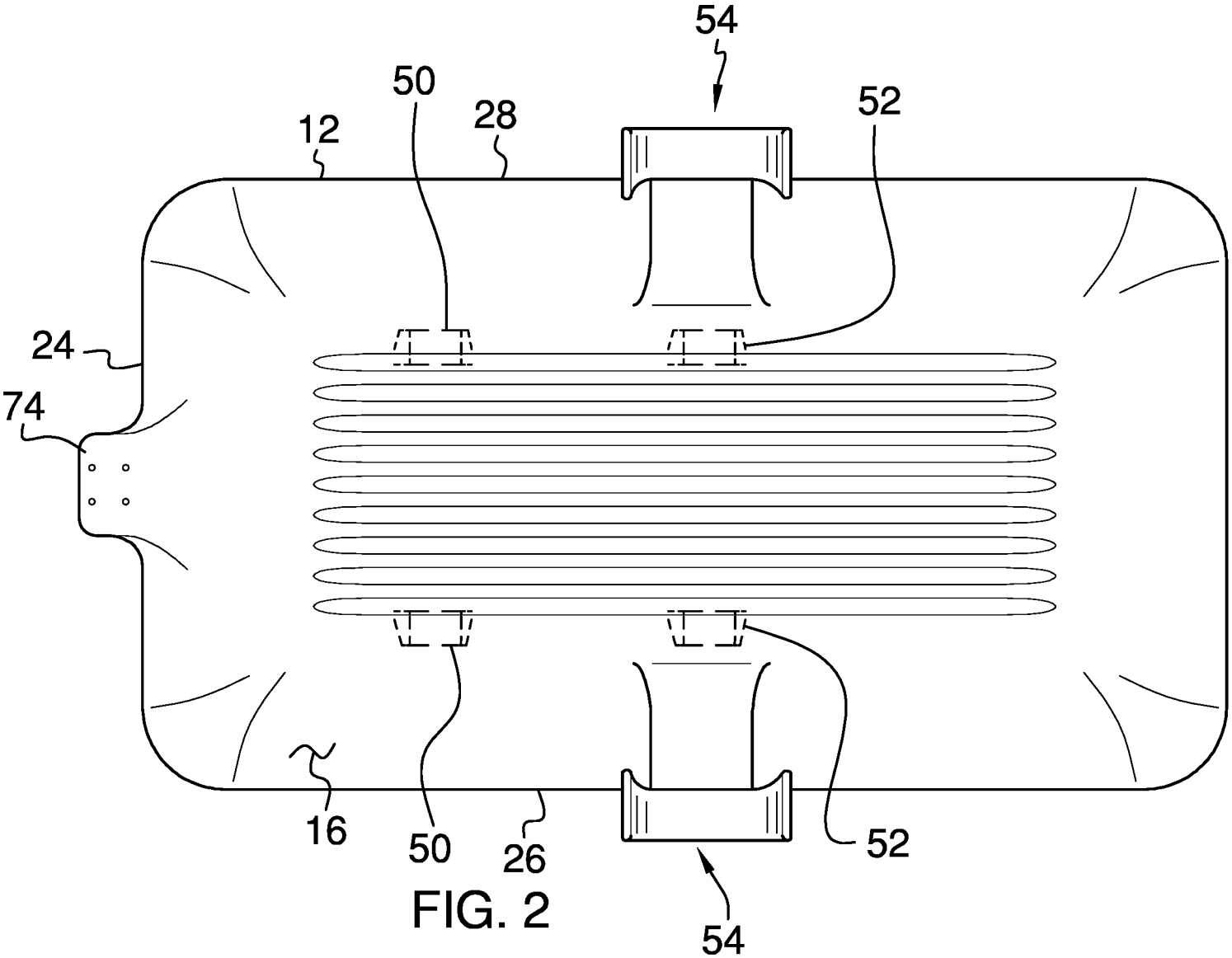
FIG. 2 is a bottom phantom view of an embodiment of the disclosure.
Figure 3:
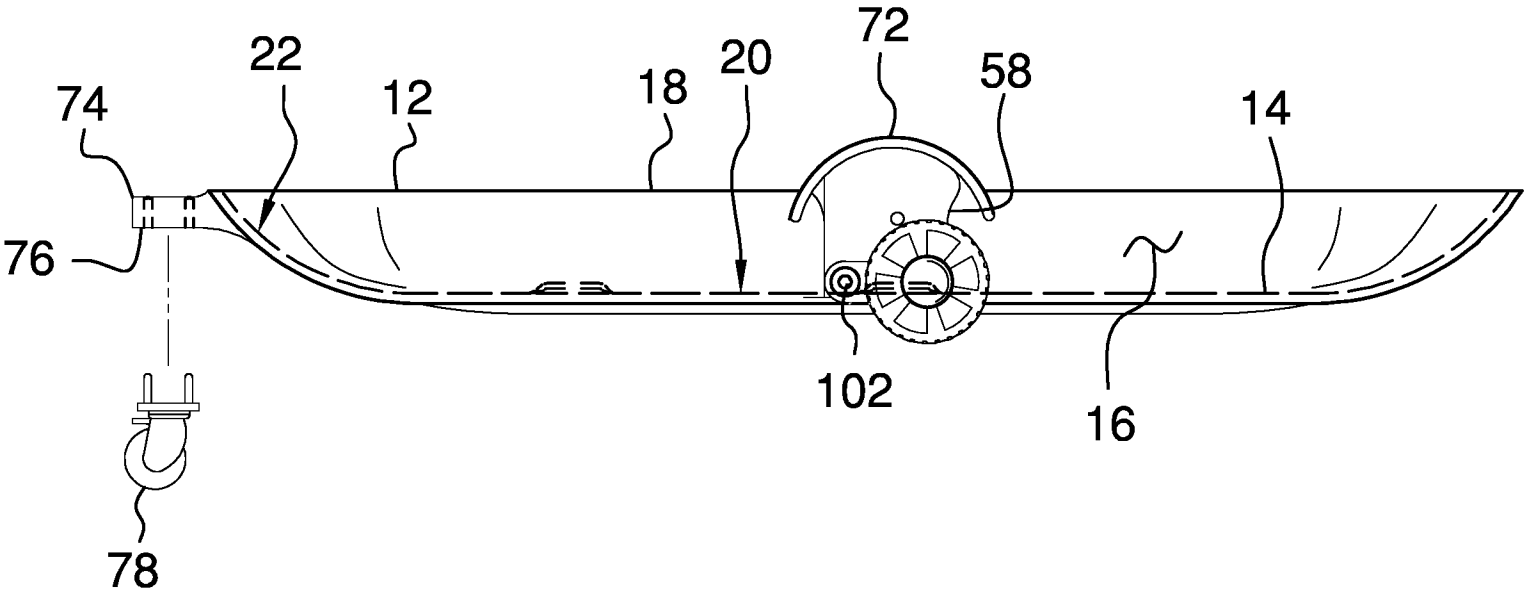
FIG. 3 is a left side phantom view of an embodiment of the disclosure.
Figure 5:
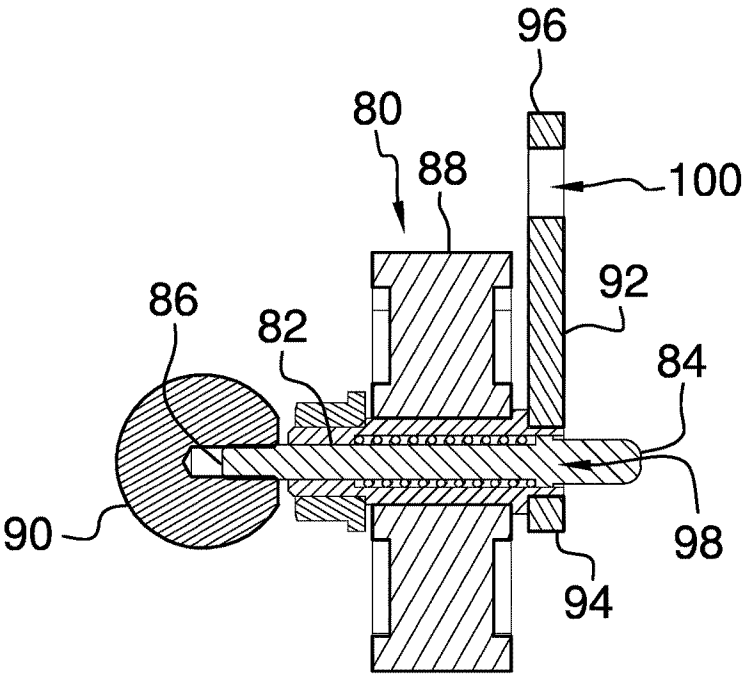
FIG. 5 is a cross sectional view taken along line 5-5 of FIG. 4 of an embodiment of the disclosure.
Figure 4:
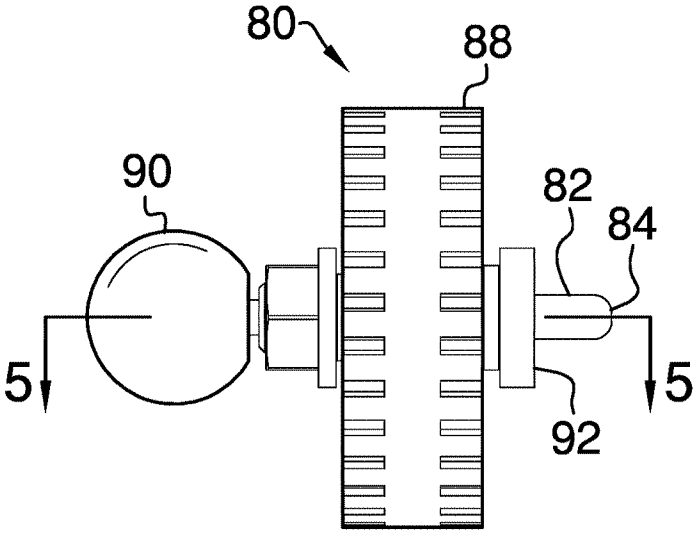
FIG. 4 is a perspective view of a wheel unit of an embodiment of the disclosure.
Figure 6:
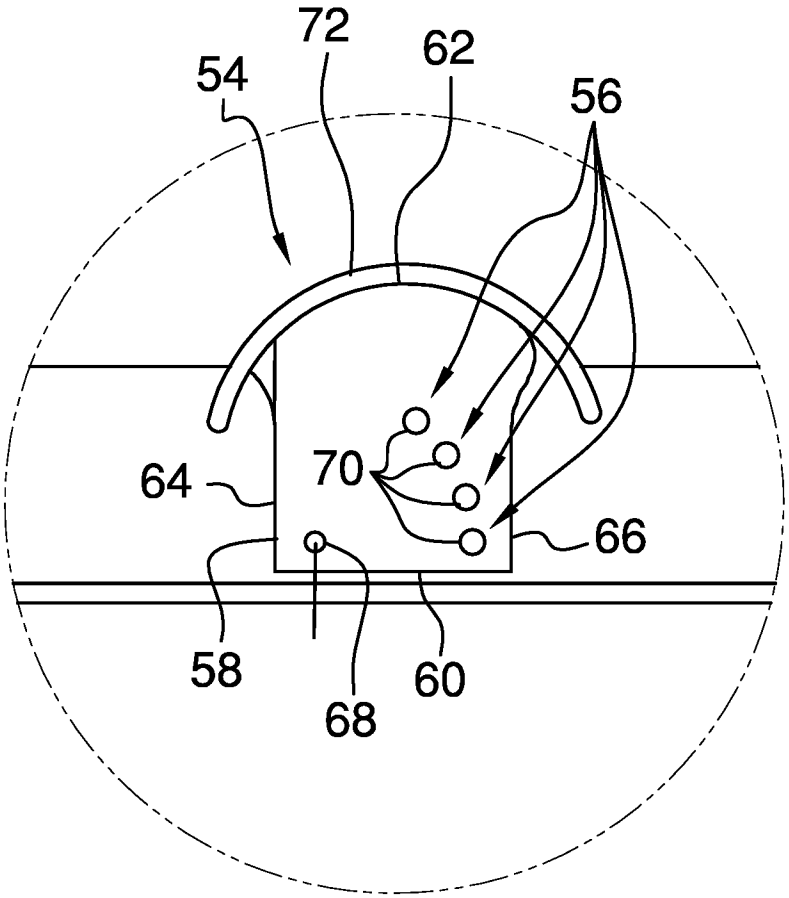
FIG. 6 is a perspective view of wheel mount of an embodiment of the disclosure.
Figure 7:
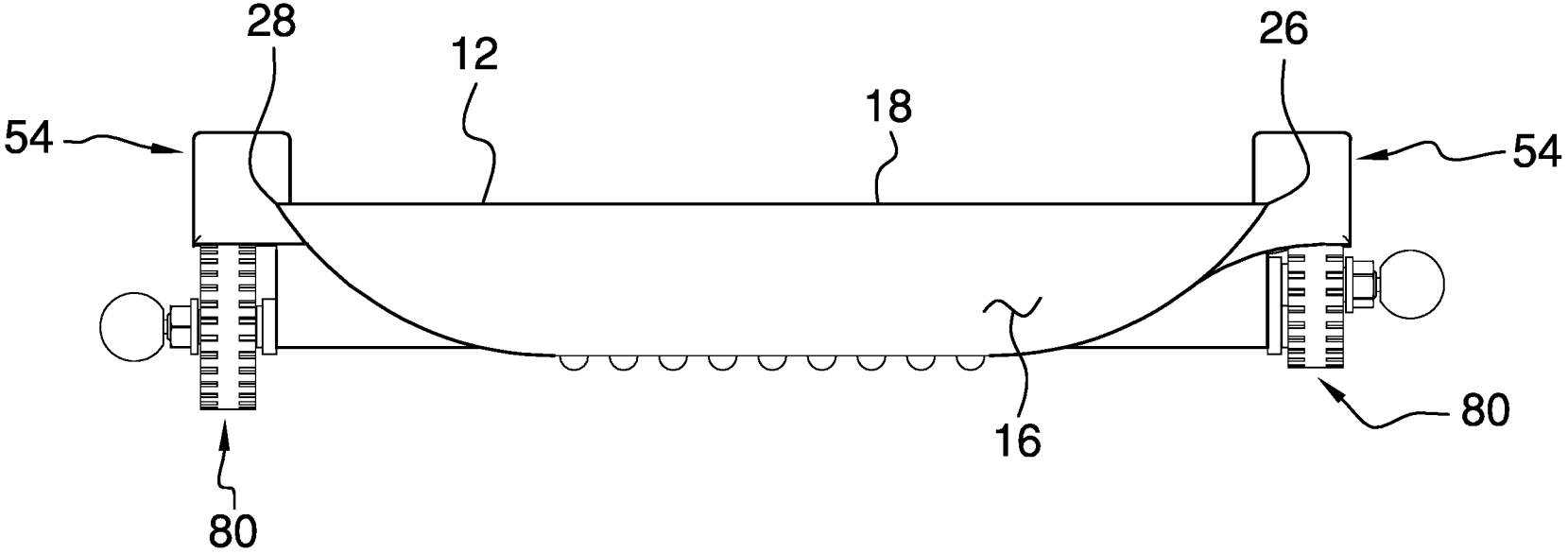
FIG. 7 is a back view of an embodiment of the disclosure.

With reference now to the drawings, and in particular to FIGS. 1 through 7 thereof, a new creeper device embodying the principles and concepts of an embodiment of the disclosure and generally designated by the reference numeral 10 will be described.

As best illustrated in FIGS. 1 through 7, the mechanic's creeper assembly 10 generally comprises a panel 12 that is worn on a user's back. The user may be a field mechanic that frequently has to lie on the ground to perform mechanical work on a machine. The panel 12 has a top surface 14, a bottom surface 16 and a peripheral edge 18 extending therebetween. The top surface 14 has a central portion 20 and an outer portion 22 extending between the central portion 20 and the peripheral edge 18. Moreover, the outer portion 22 is concavely arcuate between the peripheral edge 18 and the central portion 20 such that the panel 12 forms a bowl shape. The outer portion 22 is coextensive with the peripheral edge 18, and the peripheral edge 18 has a front side 24, a first lateral side 26 and a second lateral side 28.

A first belt 30 is slidably coupled to the panel 12 and the first belt 30 can be wrapped around the user. The first belt 30 is matable to itself to form a closed loop to retain the panel 12 on the user's back. The first belt 30 has a first end 32 and a second end 34, and a first mating member 36 is coupled to the first end of the first belt 30. A second mating member 38 is coupled to the second end 34 of the first belt 30 and the second mating member 38 releasably engages the first mating member 36 for retaining the first belt 30 in the closed loop. Each of the first 36 and second 38 mating members may be buckles, clasps or other type of releasable fastener.

A second belt 40 is slidably coupled to the panel 12 and the second belt 40 can be wrapped around the user. The second belt 40 is matable to itself to form a closed loop to retain the panel 12 on the user's back. The second belt 40 has a primary end 42 and a secondary end 44, and a primary mating member 46 is coupled to the primary end 42 of the second belt 40. A secondary mating member 48 is coupled to the secondary end 44 of the second belt 40 and the primary mating member 46 releasably engages the secondary mating member 48 for retaining the second belt 40 in the closed loop. Each of the primary 46 and secondary 48 mating members may be buckles, clasps or other type of releasable fastener.

A set of first bridges 50 is each coupled to the top surface 14 of the panel 12 and each of the first bridges 50 is aligned with an intersection between the central portion 20 and the outer portion 22. Additionally, each of the first bridges 50 is spaced from a respective one of the first 26 and second 28 lateral sides of the peripheral edge 18 of the panel 12. Each of the first bridges 50 has the first belt 30 slid therethrough for retaining the first belt 30 on the panel 12. A set of second bridges 52 is each coupled to the top surface 14 of the panel 12 and each of the second bridges 52 is aligned with an intersection between the central portion 20 and the outer portion 22. Each of the second bridges 52 is spaced from a respective one of the first 26 and second 28 lateral sides of the peripheral edge 18 of the panel 12. Moreover, each of the second bridges 52 has the second belt 40 slid therethrough for retaining the second belt 40 on the panel 12.

A pair of wheel mounts 54 is provided and each of the wheel mounts 54 is coupled to opposite sides of the panel 12. Each of the wheel mounts 54 has a plurality of engagement points 56 thereon. Each of the wheel mounts 54 comprises a plate 58 that is coupled to the peripheral edge 18 of the panel 12 having the plate 58 lying on a vertical plane. The plate 58 has a bottom edge 60, a top edge 62, a front edge 64 and a back edge 66.

The plate 58 has a pin aperture 68 extending therethrough and the pin aperture 68 is positioned adjacent to an intersection of the front edge 64 and the bottom edge 60. The plate 58 has a plurality of engagement apertures 70 extending therethrough to define the plurality of engagement points 56. The engagement apertures 70 are arranged to form an arc curving upwardly between the bottom edge 60 and the front edge 64 of the plate 58. A fender 72 is coupled to the top edge 62 of the plate 58 and the fender 72 is concavely arcuate with respect to the top edge 62.

A head rest 74 is coupled to and extends forwardly from the panel 12 to support the user's head when the user lies on the panel 12. The head rest 74 is positioned on the front side 24 of the peripheral edge 18 of the panel 12 and the head rest 74 has a downwardly facing surface 76. A roller 78 is rotatably and removably coupled to the head rest 74 for rolling along the ground when the user wears the panel 12 and lies on the ground. The roller 78 is positioned on the downwardly facing surface 76 of the head rest 74.

A pair of wheel units 80 is included and each of the wheel units 80 is removably coupled to a respective one of the wheel mounts 54 for rolling along the ground. Each of the wheel units 80 engages a selected one of the engagement points 56 in the respective wheel mount 54 thereby spacing each of wheel units 80 a selectable distance below the panel 12. In this way each of the wheel units 80 can space the panel 12 a selectable distance from the ground according to the user's preferences.

Each of the wheel units 80 comprises an axle 82 that has a first end 84 and a second end 86. A wheel 88 is provided and the axle 82 extends therethrough such that the wheel 88 is rotatably coupled to the axle 82. The wheel 88 may have a diameter of at least 5.0 inches thereby facilitating the wheel 88 to roll over uneven ground and ice or snow. A coupler 90 is releasably coupled to the second end of the axle 82 for retaining the wheel 88 on the axle 82. The coupler 90 may be a ball that has a well therein for insertably receiving the axle 82 and the ball may inhibit the second end 86 of the axle 82 from posing an injury risk to the user.

Each of the wheel units 80 includes an arm 92 that has a first end 94 and a second end 96, and the arm 92 has a first aperture 98 extending therethrough and a second aperture 100 extending therethrough. The first aperture 98 is aligned with the first end 84 of the arm 92 and the second aperture 100 is aligned with the second end of the arm 92. The first aperture 98 insertably receives the first end 84 of the axle 82 for retaining the wheel 88 on the arm 92. Each of the wheel units 80 includes a pin 102 that extends through the second aperture 100 and engages the pin aperture 70 in the plate 58 of the respective wheel mount 54. Additionally, the first end 84 of the axle 82 engages a selected one of the engagement apertures 70 in the plate 58. In this way the wheel 88 extends a selectable distance downwardly from the panel 12.

In use, the panel 12 is positioned on the user's back and each of the first 30 and second 40 belts is wrapped around the user to retain the panel 12 on the user's back. Thus, the user can lie on the ground to perform mechanical work on a machine and roll on the panel 12 in the convention of a mechanic's creeper. Additionally, each of the wheels 18 can be adjusted to lift the panel 12 a selected distance from the ground. In this way the panel 12 can more easily be rolled over hills and depressions in the ground. Moreover, the wheels 18 can space the panel 12 higher than snow that may be present on the ground thereby inhibiting the user from lying in the snow.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mechanic's creeper assembly being configured to be worn on a user's back for rolling along the ground when the user lies on the user's back, said assembly comprising:

a panel being worn on a user's back;

a first belt being slidably coupled to said panel wherein said first belt is configured to be wrapped around the user, said first belt being matable to itself to form a closed loop wherein said first belt is configured to retain said panel on the user's back;

a second belt being slidably coupled to said panel wherein said second belt is configured to be wrapped around the user, said second belt being matable to itself to form a closed loop wherein said second belt is configured to retain said panel on the user's back;

a pair of wheel mounts, each of said wheel mounts being coupled to opposite sides of said panel, each of said wheel mounts having a plurality of engagement points thereon; and a pair of wheel units, each of said wheel units being removably coupled to a respective one of said wheel mounts wherein each of said wheel units is configured to roll along the ground, each of said wheel units engaging a selected one of said engagement points in said respective wheel mount thereby spacing each of said wheel units a selectable distance below said panel wherein each of said wheel units is configured to space said panel a selectable distance from the ground.

2. The assembly according to claim 1, wherein said panel has a top surface, a bottom surface and a peripheral edge extending therebetween, said top surface having a central portion and an outer portion extending between said central portion and said peripheral edge, said outer portion being concavely arcuate between said peripheral edge and said central portion such that said panel forms a bowl shape, said outer portion being coextensive with said peripheral edge, said peripheral edge having a front side, a first lateral side and a second lateral side.

3. The assembly according to claim 2, further comprising:

said first belt having a first end and a second end;

a first mating member being coupled to said first end of said first belt; and a second mating member being coupled to said second end of said first belt, said second mating member releasably engaging said first mating member for retaining said first belt in said closed loop.

4. The assembly according to claim 3, further comprising:

said second belt having a primary end and a secondary end;

a primary mating member being coupled to said primary end of said second belt; and a secondary mating member being coupled to said secondary end of said second belt, said primary mating member releasably engaging said secondary mating member for retaining said second belt in said closed loop.

5. The assembly according to claim 4, further comprising a set of first bridges, each of said first bridges being coupled to said top surface of said panel, each of said first bridges being aligned with an intersection between said central portion and said outer portion, each of said first bridges being spaced from a respective one of said first and second lateral sides of said peripheral edge of said panel, each of said first bridges having said first belt being slid therethrough for retaining said first belt on said panel.

6. The assembly according to claim 5, further comprising a set of second bridges, each of said second bridges being coupled to said top surface of said panel, each of said second bridges being aligned with an intersection between said central portion and said outer portion, each of said second bridges being spaced from a respective one of said first and second lateral sides of said peripheral edge of said panel, each of said second bridges having said second belt being slid therethrough for retaining said second belt on said panel.

7. The assembly according to claim 2, wherein each of said wheel mounts comprises:

a plate being coupled to said peripheral edge of said panel having said plate lying on a vertical plane, said plate having a bottom edge, a top edge, a front edge and a back edge;

said plate having a pin aperture extending therethrough, said pin aperture being positioned adjacent to an intersection of said front edge and said bottom edge;

said plate having a plurality of engagement apertures extending therethrough to define said plurality of engagement points, said engagement apertures being arranged to form an arc curving upwardly between said bottom edge and said front edge; and a fender being coupled to said top edge of said plate, said fender being concavely arcuate with respect to said top edge.

8. The assembly according to claim 2, further comprising a head rest being coupled to and extending forwardly from said panel wherein said head rest is configured to support the user's head when the user lies on said panel, said head rest being positioned on said front side of said peripheral edge of said panel, said head rest having a downwardly facing surface.

9. The assembly according to claim 8, further comprising a roller being rotatably coupled to said head rest wherein said roller is configured to roll along the ground when the user wears said panel and lies on the ground, said roller being positioned on said downwardly facing surface of said headrest.

10. The assembly according to claim 7, wherein each of said wheel units comprises:

an axle having a first end and a second end;

a wheel having said axle extending therethrough such that said wheel is rotatably coupled to said axle; and a coupler being releasably coupled to said second end of said axle for retaining said wheel on said axle.

11. The assembly according to claim 10, wherein each of said wheel units comprises:

an arm having a first end and a second end, said arm having a first aperture extending therethrough and a second aperture extending therethrough, said first aperture being aligned with said first end of said arm, said second aperture being aligned with said second end of said arm, said first aperture insertably receiving said first end of said axle for retaining said wheel on said arm; and a pin extending through said second aperture and engaging said pin aperture in said plate of said respective wheel mount, said second end of said axle engaging a selected one of said engagement apertures in said plate such that said wheel extends a selectable distance downwardly from said panel.

12. A mechanic's creeper assembly being configured to be worn on a user's back for rolling along the ground when the user lies on the user's back, said assembly comprising:

a panel being worn on a user's back, said panel having a top surface, a bottom surface and a peripheral edge extending therebetween, said top surface having a central portion and an outer portion extending between said central portion and said peripheral edge, said outer portion being concavely arcuate between said peripheral edge and said central portion such that said panel forms a bowl shape, said outer portion being coextensive with said peripheral edge, said peripheral edge having a front side, a first lateral side and a second lateral side;

a first belt being slidably coupled to said panel wherein said first belt is configured to be wrapped around the user, said first belt being matable to itself to form a closed loop wherein said first belt is configured to retain said panel on the user's back, said first belt having a first end and a second end;

a first mating member being coupled to said first end of said first belt;

a second mating member being coupled to said second end of said first belt, said second mating member releasably engaging said first mating member for retaining said first belt in said closed loop;

a second belt being slidably coupled to said panel wherein said second belt is configured to be wrapped around the user, said second belt being matable to itself to form a closed loop wherein said second belt is configured to retain said panel on the user's back, said second belt having a primary end and a secondary end;

a primary mating member being coupled to said primary end of said second belt;

a secondary mating member being coupled to said secondary end of said second belt, said primary mating member releasably engaging said secondary mating member for retaining said second belt in said closed loop;

a set of first bridges, each of said first bridges being coupled to said top surface of said panel, each of said first bridges being aligned with an intersection between said central portion and said outer portion, each of said first bridges being spaced from a respective one of said first and second lateral sides of said peripheral edge of said panel, each of said first bridges having said first belt being slid therethrough for retaining said first belt on said panel;

a set of second bridges, each of said second bridges being coupled to said top surface of said panel, each of said second bridges being aligned with an intersection between said central portion and said outer portion, each of said second bridges being spaced from a respective one of said first and second lateral sides of said peripheral edge of said panel, each of said second bridges having said second belt being slid therethrough for retaining said second belt on said panel;

a pair of wheel mounts, each of said wheel mounts being coupled to opposite sides of said panel, each of said wheel mounts having a plurality of engagement points thereon, each of said wheel mounts comprising:

a plate being coupled to said peripheral edge of said panel having said plate lying on a vertical plane, said plate having a bottom edge, a top edge, a front edge and a back edge, said plate having a pin aperture extending therethrough, said pin aperture being positioned adjacent to an intersection of said front edge and said bottom edge, said plate having a plurality of engagement apertures extending therethrough to define said plurality of engagement points, said engagement apertures being arranged to form an arc curving upwardly between said bottom edge and said front edge; and a fender being coupled to said top edge of said plate, said fender being concavely arcuate with respect to said top edge;

a head rest being coupled to and extending forwardly from said panel wherein said head rest is configured to support the user's head when the user lies on said panel, said head rest being positioned on said front side of said peripheral edge of said panel, said head rest having a downwardly facing surface;

a roller being rotatably coupled to said head rest wherein said roller is configured to roll along the ground when the user wears said panel and lies on the ground, said roller being positioned on said downwardly facing surface of said headrest; and a pair of wheel units, each of said wheel units being removably coupled to a respective one of said wheel mounts wherein each of said wheel units is configured to roll along the ground, each of said wheel units engaging a selected one of said engagement points in said respective wheel mount thereby spacing each of said wheel units a selectable distance below said panel wherein each of said wheel units is configured to space said panel a selectable distance from the ground, each of said wheel units comprising:

an axle having a first end and a second end;

a wheel having said axle extending therethrough such that said wheel is rotatably coupled to said axle;

a coupler being releasably coupled to said second end of said axle for retaining said wheel on said axle;

an arm having a first end and a second end, said arm having a first aperture extending therethrough and a second aperture extending therethrough, said first aperture being aligned with said first end of said arm, said second aperture being aligned with said second end of said arm, said first aperture insertably receiving said first end of said axle for retaining said wheel on said arm; and a pin extending through said second aperture and engaging said pin aperture in said plate of said respective wheel mount, said second end of said axle engaging a selected one of said engagement apertures in said plate such that said wheel extends a selectable distance downwardly from said panel.

* * * * *